US005558312A

United States Patent [19]

Brennan

[11] Patent Number: 5,558,312

[45] Date of Patent: Sep. 24, 1996

[54] ADJUSTABLE SAFETY BRACKET FOR ROOFING

[75] Inventor: Daniel Brennan, Chana, Ill.

[73] Assignee: Safety Brackets, Inc., Chicago, Ill.

[21] Appl. No.: 380,624

[22] Filed: Jan. 30, 1995

[51] Int. Cl.[6] ..... E04H 17/14; E04G 3/00; A47B 96/06; A47L 3/02

[52] U.S. Cl. ..... 256/65; 256/59; 256/64; 248/324; 52/150; 182/113; 182/137; 182/86

[58] Field of Search ..... 256/59, 64, 65, 256/67, 69, 26, 31, DIG. 6; 182/82, 113, 138; 248/228, 237, 324, 326; 52/150

[56] References Cited

U.S. PATENT DOCUMENTS

| | | | |
|---|---|---|---|
| D. 323,777 | 2/1992 | Knox, III . | |
| 3,867,997 | 2/1975 | Hyslop, Jr. | 182/113 |
| 3,901,481 | 8/1975 | Probst . | |
| 4,452,336 | 6/1984 | Sickler | 182/82 |
| 4,666,131 | 5/1987 | Kettelkamp, Sr. et al. . | |
| 4,979,725 | 12/1990 | Hutchings, II et al. . | |
| 5,067,568 | 11/1991 | Myers . | |
| 5,113,971 | 5/1992 | Violet . | |
| 5,221,076 | 6/1993 | Z+e,uml, u+ee st . | |
| 5,248,021 | 9/1993 | Nichols . | |
| 5,331,776 | 7/1994 | Shelton et al. . | |
| 5,370,202 | 12/1994 | Nichols . | |

*Primary Examiner*—Blair Johnson
*Assistant Examiner*—Bruce A. Lev
*Attorney, Agent, or Firm*—Lockwood, Alex, Fitzgibbon & Cummings

[57] ABSTRACT

An adjustable safety bracket for use in roof construction provides a support for a safety barricade to be erected along the edge of the roof. The bracket assembly includes an attachment member which engages the free end of a roof support bracket, such as a roof joist, and a support member which is pivotally connected to the attachment member at an outer end thereof. The attachment member includes a channel portion which engages the free end of the roof support member and further includes a yoke in which the support member is pivotally supported. The support member includes a stop surface aligned with the channel portion such that when installed, the stop surface faces the free end of the roof support member and the free end limits the rotation of the support member within the attachment member.

20 Claims, 2 Drawing Sheets

ADJUSTABLE SAFETY BRACKET FOR ROOFING

BACKGROUND AND SUMMARY OF THE INVENTION

The present invention relates generally to safety guards for use on pitched roofs, and more particularly, to an adjustable safety bracket which is used in the formation of a safety barricade along the edge of a roof which will prevent a roofer from falling off a roof.

In the construction of residential, some commercial and some industrial buildings, the construction of the roof on the structure presents a safety hazard because of the roof elevation. Roofs typically have a height which is high enough from the surrounding ground to present a serious injury potential to a roofer should the roofer fall off of the roof. In roof construction, a plurality of support members are erected and spaced-apart fashion along the walls of the building. In some instances the support members are individual roofing joists attached to a ridge board, while in other instances, the support members are prefabricated roofing trusses. No matter what style the roof support members take, large plywood sheets known as sheathing are typically laid over the roof support members and nailed thereto in order to construct the base of the roof, while secondary roofing materials, such as tar paper and shingles are applied to the sheeting.

The application of the roof sheathing and other secondary roofing materials, as mentioned above, presents a safety hazard to a roofer. This hazard is increased on steeply pitched roofs, in which the angle of the roof with respect to the surrounding ground is steep. If a roofer looses his or her balance, or slips, the pitch of the roof may be steep enough to impel the roofer to slide, or roll down, to the lower edge of the roof and fall off the roof, resulting in physical injury.

It therefore becomes desirable to provide some sort of barricade or stop surface at the edge of the roof which will catch and prevent a roofer from falling. In the past, small boards, known in the art as toe boards, have been temporarily nailed to the roof support members at an angle to the nailing surfaces of the roof support members. Although these toe boards are effective at preventing tools and materials dropped by a roofer from falling off the edge of the roof and injuring individuals underneath the edge of the roof, they are incapable of stopping the fall of a roofer.

Federal Safety Regulations issued by OSHA, are scheduled to go into effect in February 1995 which mandate that every commercial, industrial and residential structure under construction have some sort of roofing safety apparatus in place. Roofing safety means are well-known in the art and may range from a single tie-off anchor which is attached to a roof support member and which provides a point of attachment for a roofer to tie off a safety line, such as that described in U.S. Pat. No. 5,248,021 to Nichols and issued Sep. 28, 1993, to a roofing protective device consisting of a plurality of safety net sections supported in a gutter and guyed to the roof by guy wires, such as that described in U.S. Pat. No. 5,221,076 to Zust and issued Jun. 22, 1993. These devices suffer from certain disadvantages. The tie-off anchor will not necessarily stop a fall if the tie-off line is too long, and the safety net device is complex in construction and requires a large amount of time for installation and removal.

Still other protective devices, such as that described in U.S. Pat. No. 5,067,586 to Myers, and issued Nov. 26, 1991 utilize a complex linkage which engages both the surface of a building wall and a leading edge of the roof and are time-consuming to install and replace, thereby increasing the labor required for the construction of the roof.

The present invention is therefore directed to a roofing safety bracket assembly which provides a solution to the aforementioned problems. In doing so, it utilizes a minimum number of components which reduce the complexity of installation and removal of the assembly during construction of the roof, thereby reducing the overall labor that must be devoted to the safety aspect of roofing construction and consequently thereby reducing the cost involved. The safety bracket assembly engages a free end of a roofing support members and includes a support post receptacle aligned with an endface of the roof support member to provide a redundant safety feature to prevent catastrophic failure of the assembly, should a retention pin of the safety bracket assembly fail which holds the assembly components in position.

In an adjustable safety bracket assembly incorporating the principles of the present invention, an attachment member is provided by which the safety bracket assembly may be attached to the free end of a roofing support member. The attachment member rotatably holds a support member therewithin proximate to its end and spaces the support member away from the roof support member end. The support member receives a barricade post therein and wood sheathing nailed to these posts along the length of the roof define a fall-breaking barrier at the edge of the roof.

The rotatable connection permits the support member to be pivoted relative to the attachment member rotated between a plurality of preselected positions which correspond to a variety of roof pitches so that the support member may be oriented upright regardless of the pitch of the roof upon which it is installed. The support member has a post-receiving opening which receives a support post, such as a 2×4, which is oriented upright with respect to the pitch of the roof. The attachment member includes a plurality of openings adapted to engage a positioning pin which extends through the attachment member and support member to fix the position of the support member with respect to the attachment member. The support member is positioned within the attachment member at a location proximate to the endface to the roof support member, so that if the positioning pin should break, the support member will rotate only slightly and a stop surface thereon will bear against the roof support member endface, thereby retaining the support post and its protective barrier attached thereto in an upright and effective fall-breaking position.

Accordingly, it is a general object of the present invention to provide an improved roof safety bracket assembly for use in roof construction which may be used to form a safety barricade at the edges of a roof under construction to substantially prevent falls off the roof.

Another object of the present invention is to provide a roof safety bracket assembly having a first leg which defines a mounting bracket of the assembly by which the assembly may be attached to a roof support member, the mounting bracket including means for attaching the assembly to the roof support member, the assembly having a second leg extending from the first leg and pivotally connected thereto, the second leg being held within an open end of the mounting bracket, the second leg having a hollow base portion which is adapted to receive a barricade support post therein to which may be attached a protective barricade member extending lengthwise along an edge of the roof, the assembly further including a positioning means adapted to fix the position of the second leg with respect to the first leg in order to maintain the second leg and a barricade support post held thereby in an upright position irrespective of the pitch of the roof.

A further object of the present invention is to provide a roofing safety bracket which engages the end of a roof support member and which supports a post in an upright position to which a safety barrier, such as a plywood sheet, may be affixed, the bracket including a roof attachment member having a channel portion and a bracket portion, the bracket portion extending out from the channel portion, a barrier post-receiving member pivotally mounted within the bracket portion of the attachment member, the barrier post-receiving member opposing the channel portion, whereby, when the roof attachment member is attached to the roof support member such that the roof support is held within said channel portion and an end of the roof support approaches the bracket portion thereof, the barrier post-receiving member presents a stop surface in opposition to the roof support end and engages same upon pivoting about a pivot point, this engagement retaining the barrier post-receiving marker in an upright position.

These and other objects, features, advantages of the present invention will be will be clearly understood through a consideration of the following detailed description, taken in conjunction with the accompanying drawings.

BRIEF DESCRIPTION OF THE DRAWINGS

In the course of this detailed description, reference will be made to the accompanying drawings wherein like reference numerals refer to like parts and wherein.

DETAILED DESCRIPTION OF THE INVENTION

Figure 1:
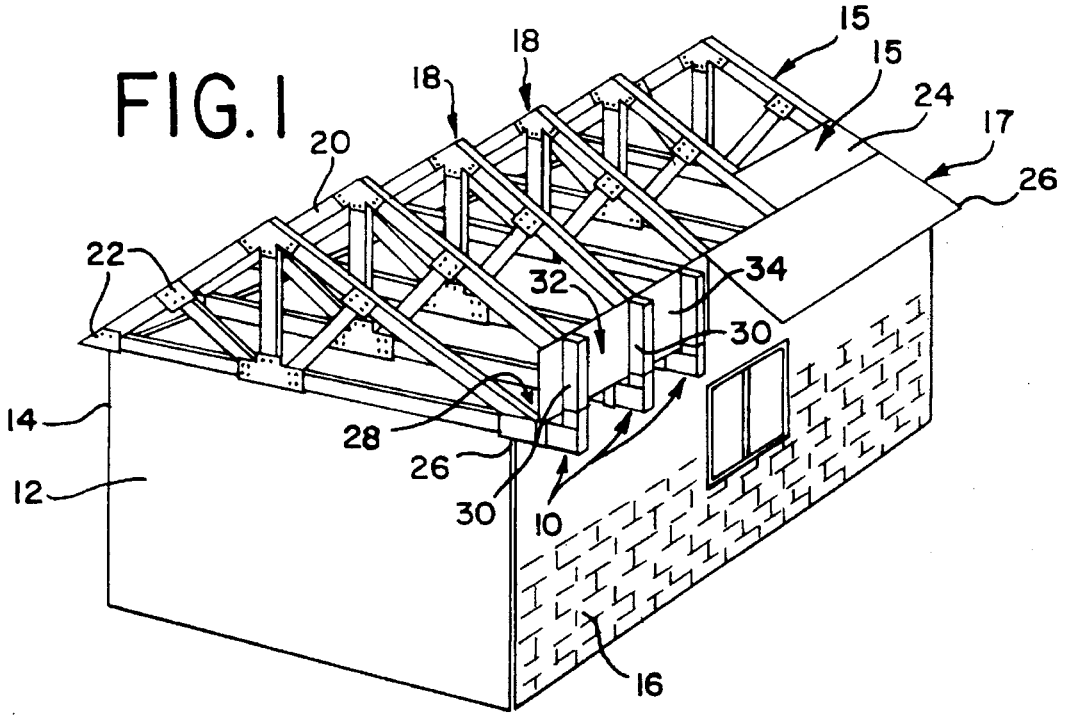
FIG. 1 is an overall perspective view of a structure under construction illustrating the environment in which the present invention is used.

An embodiment of an adjustable safety bracket assembly constructed in accordance with the principles of the present invention is generally indicated at 10 in the figures. FIG. 1 illustrates a typical structure 12 under construction wherein various walls 14, 16 of the structure had been erected to define the exterior perimeter of the structure. Once these walls 14, 16 are erected, the natural progression in construction is to then erect the roof on top of the walls.

A series of roof supports 18, illustrated in FIG. 1 as prefabricated trusses 20, may subsequently be applied to the tops of the walls 14, 16 of the structure by any conventional means, such as lifting or cranes, and are spaced apart in a predetermined spacing along the walls, such as 16-inch centers. The trusses 20 are typically formed from individual wooden components which are nailed together and further have appropriate interconnecting plates 22 as illustrated which serve to reinforce the joints of the components. Once positioned in a predetermined spacing, the roof trusses 20 are affixed thereto using conventional fasteners such as nails, screws or the like.

Once the roof supports 18 are in place on the structure and fastened thereto, roofing sheathing 24 is applied to the roof supports 18. The sheathing 24 typically comprises large plywood sheets having dimensions of 4 feet by 8 feet, which are nailed to the roof supports 18. It is during this phase of roof construction that the falling hazard is perhaps greatest to a roofer. The present invention provides an adjustable roofing safety bracket assembly which enables the erection of a safety barricade along at the edge of the roof.

Figure 2:
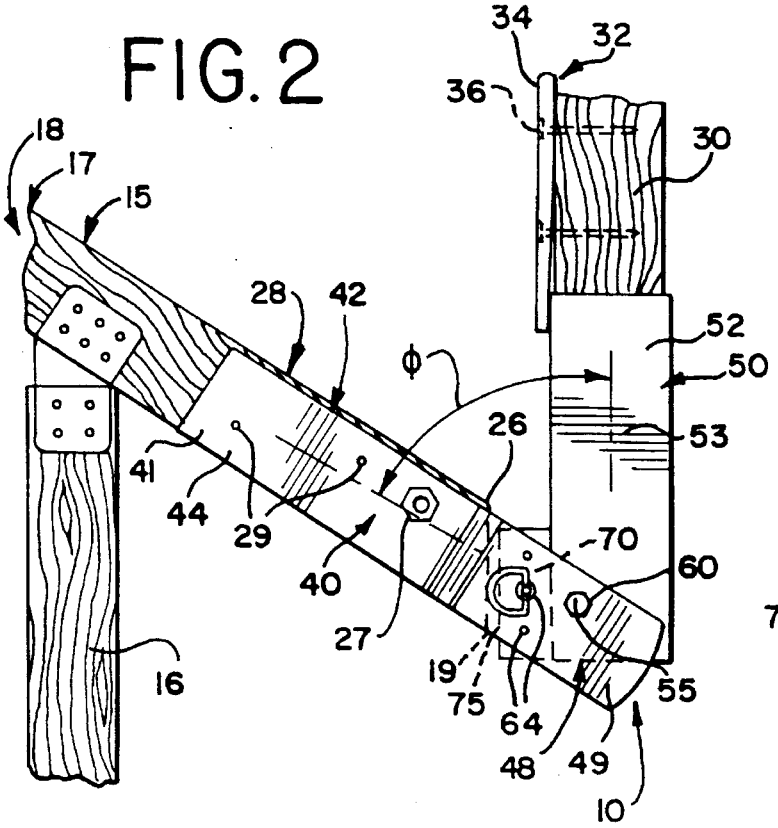
FIG. 2 is a elevational view of a safety bracket assembly constructed in accordance with the principles of the present invention shown installed in place along the edge of a roof.

As illustrated in FIG. 1, a series of safety bracket assemblies 10 are shown installed along a portion of the roof edge 26. In actual use, the bracket assemblies 10 will be installed along the entire length of the roof edge. The safety bracket assemblies 10 are used to construct a safety barricade 32 by attaching the assemblies 10 along the roof edge 26 to the free ends 28 of the roof support members joists or trusses (FIG. 2). Each of the bracket assemblies 10, as explained below, serves to support a barricade post 30 along the edge of the roof. The barrier posts 30 are supported upright with respect to the pitch of the roof 17. The posts 30 provide support for a safety barrier, or barricade 32, along the roof edge 26 which is formed from elongated wooden members 34. These barricade members 34 may be as large as the roof sheathing 24, or they may be smaller wooden sections such as lengths of 1×16 lumber. Regardless of their size, the barricade members 34 are affixed to the support posts 30 by fasteners 36 as shown in FIG. 2 such as nails, screws or the like and are thereby supported at and above the surface of the roof to define a continuous barricade which extends along the roof edge 26.

Figure 3:
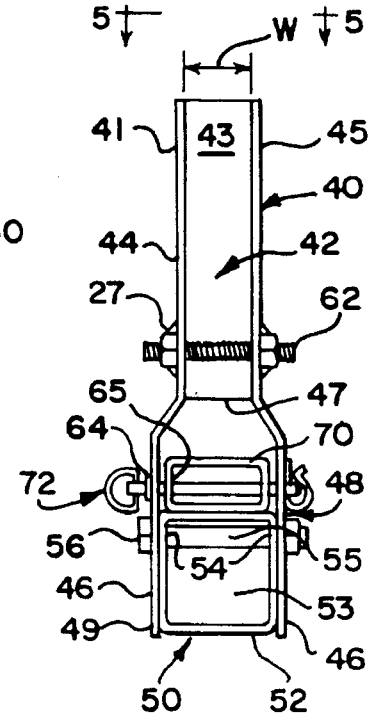
FIG. 3 is an top plan view of the safety bracket assembly of the present invention.

Turning now to FIG. 2, it can been seen that a safety bracket assembly 10 of the present invention includes a first leg, or attachment member 40, which is attached at one end 41 of the first leg member to the free end 28 of a roofing support member 18, illustrated in FIG. 2 as a roof joist. The first leg member 40 includes an elongated channel portion 42 having a width W large enough to accommodate the width of a dressed roof joist or truss member (FIG. 3). In this regard, the width W may be slightly greater than 1½ inches, which is the standard width dimension for 2× lumber to thereby permit the user to slide the first leg member 40 of the bracket assembly 10 onto the roof support free end 28.

Figure 5:
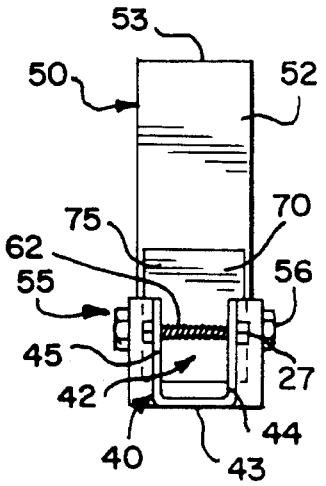

As shown best in FIGS. 3&5, the channel portion 42 of the first leg member 40 includes a base 43 disposed between two opposing sidewalls 44, 45. It may be formed by bending a section of sheet metal stock along two generally parallel lines to define an integral channel portion, or it may be formed by welding separate basewall and sidewall pieces together. The channel sidewalls 44, 45 form two spaced-apart arm portions 46 which generally begin at the end 47 of the channel portion 42, as defined by the termination of the basewall 43, and extend a sufficient distance outwardly therefrom to the opposing end 49 of the first leg member 40 to define a bracket portion 48 which accommodates a second leg member 50 of the bracket assembly 10. The sidewalls 44, 45 diverge from each other between the channel portion 42 and bracket portion 48 as illustrated in FIG. 3.

Figure 4:
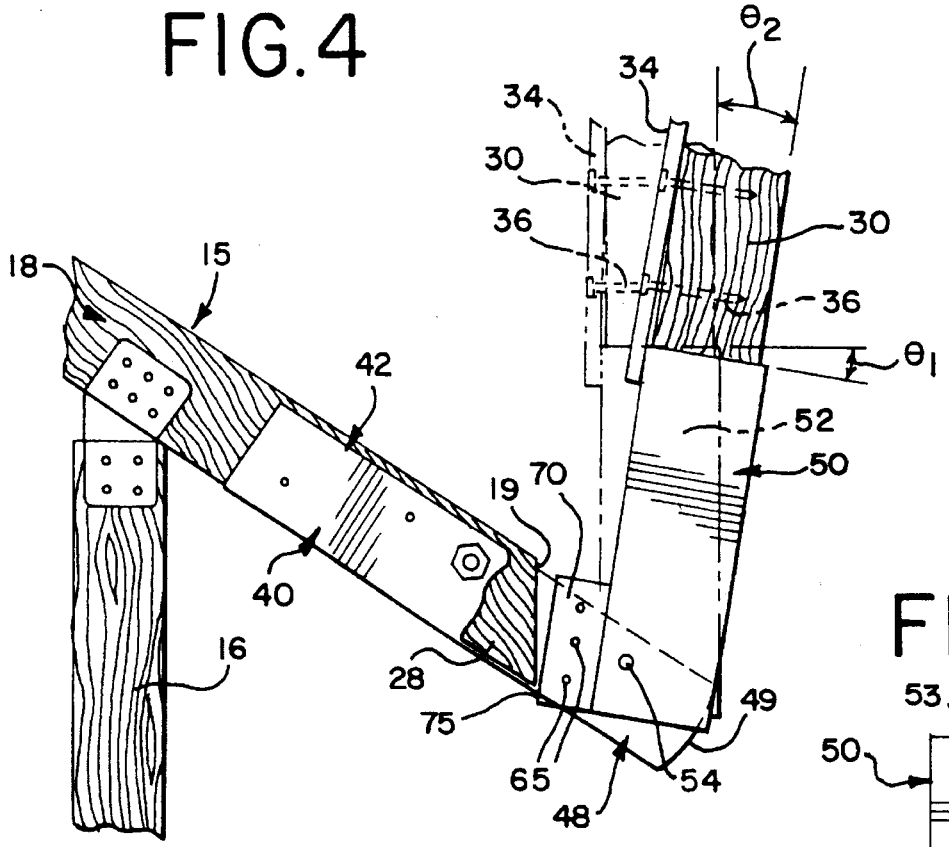
FIG. 4 is the same view as FIG. 2, but diagrammatically illustrating the movement of the second leg and its engagement with the end of the roof support member which occurs if the retention pin is inoperative; and, FIG. 5 is an end view of the safety bracket assembly of FIG. 3 taken along lines 5—5 thereof.

As best illustrated in FIGS. 2 & 4 first leg member 40 may be considered as an attachment member by virtue of its attachment to the roof supports 18, and the second leg member 50 may be considered as a support member because it serves to adjustably support a barricade post 30 in an upright orientation with respect to the pitch of the roof working surface 15. In FIG. 2, the barricade post 30 is shown at an angle $\phi$ to the roof working surface 15. In this regard, the second leg member 50 preferably includes a hollow, generally rectangular, metal section 52 having a height sufficient to define a receptacle portion 53 therein. The second leg member 50 includes a pair of openings 54 disposed in the sides of the metal section 52 near the bottom of the leg member 50 which accommodate a roll pin 55 therethrough, illustrated as a bolt and cap screw assembly 56 (FIG. 3).

The first leg member 40 also contains like openings 60 formed near the ends of the arm portions 46 of the bracket portion 48 thereof which also receive the roll pin 55 therethrough. The roll pin 55 establishes a pivotal connection between the first and second leg members 40, 50 by which the position of the two leg members with respect to each other and the roof working surface 15 may be adjusted in order to accommodate various pitches of roofs 17.

The first leg member channel portion 42, includes means for attaching the leg member 40 to the roof support 18, shown as openings 29, which are disposed in the channel portion sidewalls 44, 45. These openings 29 are preferably staggered with respect to each sidewall and receive nails or other fasteners (not shown) so that the first leg member 40 may be secured to the roof support 18. Additionally, these openings may include threaded members aligned therewith, illustrated as nuts 27, which are adapted to receive a threaded connector formed from a piece of threaded stock 62.

In an important aspect of the present invention and, as best illustrated in FIG. 4, the safety bracket assembly 10 includes a means for fixing the position of the second leg member 50 with respect to the first leg member 40 and the pitch of the roof as well as for restraining movement of the second leg member 50 within the first leg member bracket portion 48 and with respect to the first leg member 40. This fixing and restraining means includes a first set of positioning openings 64 disposed within the first leg member bracket portions 40 and a second set of positioning openings 65 disposed in a portion of the second leg member 50, shown as an extension portion 70 thereof. The two sets of positioning openings 64, 65 are arranged in their respective first and second leg members in a prearranged pattern, with the first openings 64 shown disposed in the first leg member 40 in a divergent angled pattern from the base of the first leg bracket portion 48 (and generally following a vertical line when the first leg member 40 is installed on a roof support 18 as in FIG. 2) and spaced apart from the roll pin 55, while the second openings 65 are shown in a staggered offset pattern in the second leg member extension portion 70 as illustrated in FIG. 4.

A position retention pin assembly 72 is provided which engages aligned set of openings 64, 65 to thereby fix the position of the second leg member with respect to the first leg member 40. Because of the different arrangements of the first and second openings 64, 65 of the respective first and second leg members 40, 50, the bracket assembly 10 illustrated is capable of being fixed in at least three different angular orientations corresponding to three different roof pitches. A greater number of openings may be formed in the first and second members in order to permit a larger number of orientation combinations.

In another important aspect of the present invention, the second leg member 50 may also include an extension 70, shown as structural tubular section which is attached to the second leg hollow section 52 by suitable means such as welding. This extension 70 provides a location for the second set of positioning openings 65 which is removed from the receptacle portion 53 of the second leg member 50. Thus, the retention pin 72 will not interfere with the support post 30 held in the receptacle portion 53, thereby allowing the receptacle portion 53 to be deeper and provide greater structural stability to the barricade posts 30. Were the positioning openings 65 located in the sidewalls of the receptacle portion 53, the retention pin 72 would interfere with the barricade post 30. Thus a longer, and hence more rigid, support post receptacle 53 is enabled by use of the second leg extension 70.

In yet another important aspect of the present invention, the first leg member bracket portion 48 extends a sufficient distance from the channel portion 42 to define a sufficiently long opening 51 therebetween in which the second leg member 50 pivots therein around the roll pin 55. The second leg member extension 70, as illustrated, is attached to the forward face of the second leg member 50 and includes an elongated stop surface 75 on a forward face thereof which opposes an end face 19 of the roof support 18 enclosed within the first leg channel portion 42. This extension portion 70 provides the bracket assembly 10 of the present invention with an important redundant safety mechanism in that second leg member 50 and its associated extension portion 70 are enclosed within the first leg member bracket portion 48 and maintained therein in alignment with an endface 19 of the roof support 18 held within the first leg member channel portion 42. Therefore, if the user should inadvertently remove the retention pin assembly 72 from the bracket assembly 10 during installation onto a roof edge 26 or lose the retention pin, or if the retention pin assembly should shear or break by virtue of a sudden impact load against the safety barricade 32, the second leg member 50 will pivot slightly until the stop surface 75 of the extension portion 70 engages the roof support endface 19 and bear against it. This engagement between the second leg member 50 and the roof support 18 will prevent failure of the barricade.

This engagement is best illustrated in FIG. 4, wherein the arm portion 46 of the bracket portion 48 facing the viewer has been removed for clarity and wherein the positioning pin assembly 72 has not been inserted into its corresponding positioning pin openings. Assuming that the retention pin assembly 72 has not been inserted or that it has failed, the second leg member 50 will pivot clockwise as indicated by the arrows around the roll pin 55 for an angle of revolution indicated by $\theta_2$. This pivotal movement causes the top of the second leg member hollow section 52 to diverge from its previous position by a similar angle $\theta_1$. This movement impels the second leg member extension stop surface 75 into a bearing-like contact with the endface 19 of the roof support 18 which holds the second leg member 50.

This contact effectively prevents an impact load which shears the roll pin from resulting in disassociation of the second leg member from the first leg member and failure of the entire bracket assembly. Thus, if a worker should slip or fall down a slope of the roof 15, his or her momentum may develop a great enough force to shear the positioning pins in the bracket assemblies 10, and the second leg member 50 and the barricade walls and support posts 30 supported thereby are prevented from any significant rotation outwardly which would result in a failure of the barricade for its intended purposes. Additionally, this arrangement may be utilized to reduce any impact load on the retention pin assembly 72 by placing the roof support 18 in the first leg channel portion 42 and bracket portion 48 to the point where it virtually abuts the roof support endface 19, to thereby provide an additional surface to resist the impact load.

It will be appreciated that the embodiments of the present invention which have been discussed are merely illustrative of some of the applications of this invention and that numerous modifications may be made by those skilled in the art without departing from the true spirit and scope of this invention.

I claim:

1. An adjustable safety bracket assembly for forming a support for a safety barricade erected along the edge of a roof of a structure, the roof having a plurality of roof support members spaced along the structure which provide a support for sheathing applied to the roof support members, said roof support member defining a working surface of said roof, at least one of said roof support members having a free end, the safety bracket assembly comprising:

an elongated attachment member for attaching said safety bracket assembly to the roof support member free end, the attachment member having first and second opposing ends and two sidewalls extending between the opposing ends, said sidewalls cooperating with a basewall to define a channel portion of said attachment member at said first end thereof, said sidewalls being spaced apart from each other at said attachment member second end to define a yoke portion;

a barricade support member pivotally connected to said attachment member second end at a pivot point, the barrier support member including a hollow portion which defines a receptacle which receives a support post therein and holds the support post in an upright position with respect to the working surface of said roof;

means for fixing a position of and for restraining movement of said barrier support member with respect to said attachment member, the position fixing and movement restraining means including first openings in said attachment member sidewalls proximate said second end thereof, second openings in said barrier support member and a retention pin adapted for insertion through a set of aligned first and second openings, which when inserted through said aligned set of first and second openings, fixes said barrier support member relative to said attachment member and restrains movement of said barrier support member relative to said attachment member, said barrier support member including a second, redundant means for restraining movement of said barrier support member relative to said attachment member, the redundant movement restraining means including a stop surface disposed thereon aligned with said attachment member channel portion and opposing said roof support member endface when said safety bracket assembly is installed upon said roof support member, whereby if said retention pin fails to restrain movement of said barrier support member relative to said attachment member, pivotal movement of said barrier support member about said pivot point is restrained by interference between said barrier support member stop surface and said roof support member endface.

2. The safety bracket assembly as defined in claim 1, wherein said attachment member basewall includes a reinforcement plate disposed between said attachment member sidewalls.

3. The safety bracket assembly as defined in claim 1, wherein said attachment member sidewalls extend from said channel portion to said yoke portion, said attachment member sidewalls having a width in said yoke portion which is greater than a width of said attachment member sidewalls in said channel portion.

4. The safety bracket assembly as defined in claim 1, wherein said barrier support member includes an extension portion, the barrier support member stop surface being disposed on a face of said extension portion.

5. The safety bracket assembly as defined in claim 1, wherein said first openings are disposed in said attachment member sidewalls at an angle with respect to said channel portion basewall and said second openings are disposed in said barrier support member outside of said receptacle.

6. The safety bracket assembly as defined in claim 5, wherein said barrier support member includes an extension portion and said second openings are disposed in said extension portion.

7. The safety bracket assembly as defined in claim 1, wherein said attachment member and said support member are formed from metal.

8. The safety bracket assembly as defined in claim 1, wherein said attachment member channel portion is generally rectangular and said barrier support member receptacle is generally rectangular.

9. The safety bracket assembly as defined in claim 1, wherein said attachment member sidewalls diverge from said channel portion to said bracket portion.

10. A safety barrier apparatus for use in constructing a safety barrier along an edge of a roof of a structure under construction wherein the safety barrier apparatus supports a barrier post in an upright position with respect to a working surface of the roof, such that a series of said safety barrier apparatuses, when installed in a spaced-apart relationship along the edge of said roof, support a series of barrier posts which likewise support a series of barrier members extending lengthwise along said roof edge, said safety barrier apparatus comprising: a first leg member having first and second opposing ends, the first leg member having two opposing sidewalls extending between the opposing first and second ends, said first leg member having a channel portion disposed at said first end and extending toward the second end, said first leg member having two opposing sidewalls which extend from said first leg channel portion toward said first leg member second end and which define a bracket portion disposed at said first leg member second end, said first leg channel portion receiving a portion of a roof support member therein when said apparatus is installed upon a roof, the bracket portion defining a space extending longitudinally between said first leg member sidewalls toward said first leg member first end; a second leg member having a generally elongated hollow member extending between opposing first and second ends thereof, the second leg member first end being disposed in said first leg member bracket portion between said first leg member sidewalls thereof, said second leg member being pivotally connected to said first leg member near said first and second leg member second ends, said second leg member further having a hollow receptacle portion which receives a portion of a roof barrier post therein, said first leg member including a first set of openings in said sidewalls thereof and said second leg member including a second set of openings therein and removed from said receptacle portion thereof, said safety barrier apparatus further including a retention pin assembly for engaging an aligned set of said first and second openings, whereby pivotal movement of said second leg member with respect to said first leg member is substantially prevented, and whereby said second leg member is maintained in an upright position with respect to said first leg member.

11. The safety barrier apparatus as defined in claim 10, wherein said second leg member includes an extension portion extending toward said first leg member first end, the extension portion having a stop surface defined thereon which opposes an endface of a roof support member received within said first leg member channel portion when said apparatus is installed upon a roof.

12. The safety barrier apparatus as defined in claim 11, wherein said second set of openings are disposed in said second leg extension portion.

13. The safety barrier apparatus as defined in claim 11, wherein said second leg member includes a rectangular hollow metal section and said second leg member extension portion includes a hollow metal section.

14. The safety barrier apparatus as defined in claim 10, wherein said first set of openings are disposed in said first leg member sidewalls at an angle from one of said first leg member ends and said second set of openings are disposed in said second leg member in an offset pattern.

15. The safety barrier apparatus as defined in claim 10, wherein said second leg member includes a stop surface thereon removed from said receptacle portion thereof, the second leg member stop surface being generally aligned with said first leg member channel portion and said second leg member being positioned within said first leg bracket portion proximate to said channel portion, whereby when a roof support is received within said channel portion when said apparatus is installed upon a roof, said second leg member stop surface opposes an endface of said roof support and is spaced a minimum distance therefrom to limit rotation of said second leg member relative to said first leg member, thereby providing additional prevention of movement of said second leg member within said first leg member.

16. The safety barrier apparatus as defined in claim 10, wherein said first leg member portions diverge outwardly between said first leg member opposing ends.

17. A bracket assembly for installation onto a roof support beam for supporting a post in an upright position at an edge of a roof of a structure, the roof including a plurality of spaced-apart support beams, the post providing a foundation for an upright safety barricade at the roof edge, the bracket assembly comprising:

an elongated attachment member having two sidewalls extending generally between opposite ends of the attachment member, the sidewalls being interconnected by a basewall for a portion of their length and defining a passage partially extending lengthwise between said attachment member opposing ends, the passage receiving an end portion of a roof support beam therein when said bracket assembly is installed upon a roof support beam, said sidewalls having means which permit said attachment member to be removably attached to said roof support beam portion, said sidewalls extending beyond said basewall to define two opposing arms which cooperate to define a bracket portion of said attachment member, the bracket portion receiving a post support member therein between said sidewalls, the post support member being pivotally attached to said attachment member, whereby said post support member may be pivoted in said bracket portion with respect to said attachment member, said post support member including a hollow, elongated receptacle portion which receives a support post therein and an extension portion which is removed from the receptacle portion, the post support member extension portion being axially aligned with said attachment member passage and further having a stop surface thereon which confronts said attachment member passage, said attachment member including a set of first openings in said bracket portion thereof and said post support member extension portion including a second set of openings, individual pairs of said first and second sets of opening being aligned with each other as said post support member is pivoted within said attachment member bracket portion, a retention pin which extends through aligned first and second sets of openings to fix said post support member in an upright position relative to said attachment member, said post support member stop surface being disposed in opposition to an endface of a roof support beam received within said attachment member passage when said bracket assembly is installed upon said roof such that said stop surface interferingly contacts said roof support beam endface when said retention pin does not extend through said aligned first and second openings, thereby independently maintaining said post support member in said upright position.

18. The bracket assembly as defined in claim 17, wherein said attachment members diverge outwardly with respect to said passage to define said bracket portion arms.

19. The bracket assembly as defined in claim 17, wherein said first set of openings are disposed in an angled pattern with respect to said passage basewall and said second set of openings are disposed in an offset pattern.

20. The bracket assembly as defined in claim 17, wherein said attachment member includes a hollow channel.

* * * * *